United States Patent [19]

Haller

[11] 4,307,772

[45] Dec. 29, 1981

[54] MOLD FOR ELECTROMAGNETIC CASTING

[75] Inventor: Walter Haller, Sierre, Switzerland

[73] Assignee: Swiss Aluminium Ltd., Chippis, Switzerland

[21] Appl. No.: 127,699

[22] Filed: Mar. 6, 1980

[30] Foreign Application Priority Data

Mar. 7, 1979 [CH] Switzerland ..... 2202/79

[51] Int. Cl.[3] ..... B22D 11/10

[52] U.S. Cl. ..... 164/467; 164/487; 164/503

[58] Field of Search ..... 164/49, 147, 250, 251, 164/348, 444, 89

[56] References Cited

U.S. PATENT DOCUMENTS 3,741,280 6/1973 Kozheurov et al. ..... 164/250

4,040,467 8/1977 Alberny et al. ..... 164/147 X

FOREIGN PATENT DOCUMENTS 233186 4/1969 U.S.S.R. ..... 164/49

*Primary Examiner*—Gus T. Hampilos

*Attorney, Agent, or Firm*—Bachman and LaPointe

[57] ABSTRACT

A mold for electromagnetic continuous casting has a supporting frame for an induction coil and a cooling device which features at least one nozzle for directing a liquid coolant onto the surface of the ingot being cast. A section (15) is provided in line with the stream of liquid coolant emerging from at least one nozzle such that it provides an impacting surface for deflecting the stream of coolant onto the surface of the ingot.

19 Claims, 5 Drawing Figures

MOLD FOR ELECTROMAGNETIC CASTING

BACKGROUND OF THE INVENTION

The present invention relates to a mold for electromagnetic casting having an induction coil, and a coiling device which features at least one nozzle for directing a liquid coolant at the surface of the ingot being cast.

The quality of the product produced by the vertical continuous casting of metals in high frequency electromagnetic mold depends to a very large extent on the level at which the coolant impinges on the surface of the solidifying ingot as the ingot is lowered during casting.

The German Pat. No. 22 02 910 teaches the use of a slit as a nozzle for liquid coolant which is directed at the ingot being cast. The coolant emerges from this nozzle in the form of a stream which is inclined to the surface of the ingot and strikes the ingot at an angle to the main axis or direction of casting; the angle and the level of impingement remain the same for all charges cast. The fixed inclination of the slit also determines the final direction of the stream of coolant.

It is a principal object of the invention to develop a continuous casting mold which allows for effortless fine regulation of the angle of impingement of the stream of coolant onto the ingot surface independent of any corrections which may be required in the electromagnetic field of the mold. It is a further object, in particular with large format ingots, to enable the area of impingement all around the ingot to be varied—thus altering and increasing the cooling effect.

SUMMARY OF THE INVENTION

The foregoing objects are achieved by way of the present invention in that, in terms of the direction of flow of the coolant, after the nozzle opening/openings which forms/form a ring-shaped gap, there is a section which projects into the path of the coolant emerging from the ring-shaped gap providing an exchangeable impacting surface which is curved or inclined with respect to the direction of casting. This surrounds the ingot and deflects the coolant emerging from the ring-shaped gap in another direction, so that the height and angle at which the coolant strikes the ingot can be varied.

The section is, from the constructional point of view, independent—if desired situated in a recess in the induction coil and/or in the supporting framework. Thanks to this, the optimum point and angle of impingement of the coolant on the ingot can be selected without having to take into account corrections for the metallostatic pressure in the ingot and without substantially affecting the magnetic field—a feature which, in particular, allows special alloys to be cast.

It has been found particularly favorable to provide the section with an exchangeable attachment which serves as the impacting surface. The ease of changing the section or the attachment allows a specific electromagnetic continuous casting unit to be converted for casting other alloys or other drop rates (casting speeds) by making only a few alterations; up to now this required the use of another metal screen and also changing the whole coolant feed system.

Usefully the radial cross section of the deflecting section can be given the shape of a suitable segment of a curve (for example a segment of a parabola), as a result of which the stream of coolant also adopts the shape of such a curve and allows the device possibilities in design which are not available with a linear or flat stream of coolant.

According to another feature of the invention the section and the attachment are made of an electrically insulating plastic, preferably a fiber glass reinforced epoxy type plastic, so that the magnetic field is not affected. It is also within the scope of the invention to have the section and/or attachment made out of a hollow section. To achieve uniform solidification in the ingot being cast, it can be useful, in particular when casting large format rectangular cross sections, to change the area of impingement—and with that the angle of impingement—, so that the line of intersection of film of coolant and the ingot do not lie on a horizontal plane. For this reason therefore, according to the invention, the impacting surface on each side of a mold for continuous casting of rectangular cross sections should be such that in an end view it represents an arch with its crown in the middle. This way the ingot being cast is cooled later at its corners i.e. lower down and at a smaller angle—preferably less than 20°—than in the center of each side face.

The drawings show a number of different exemplified embodiments of the invention which are described hereinbelow wherein FIG. 1: Is a cross section through a part of a continuous casting mold with a cooling device.

FIGS. 2 and 3: Are further embodiments for the part A shown in FIG. 1.

FIG. 4: Is a schematic, perspective view of a detail of the cooling device.

FIG. 5: Is a cross section through the detail shown in FIG. 4 sectioned along line V—V.

DETAILED DESCRIPTION

Figure 1:
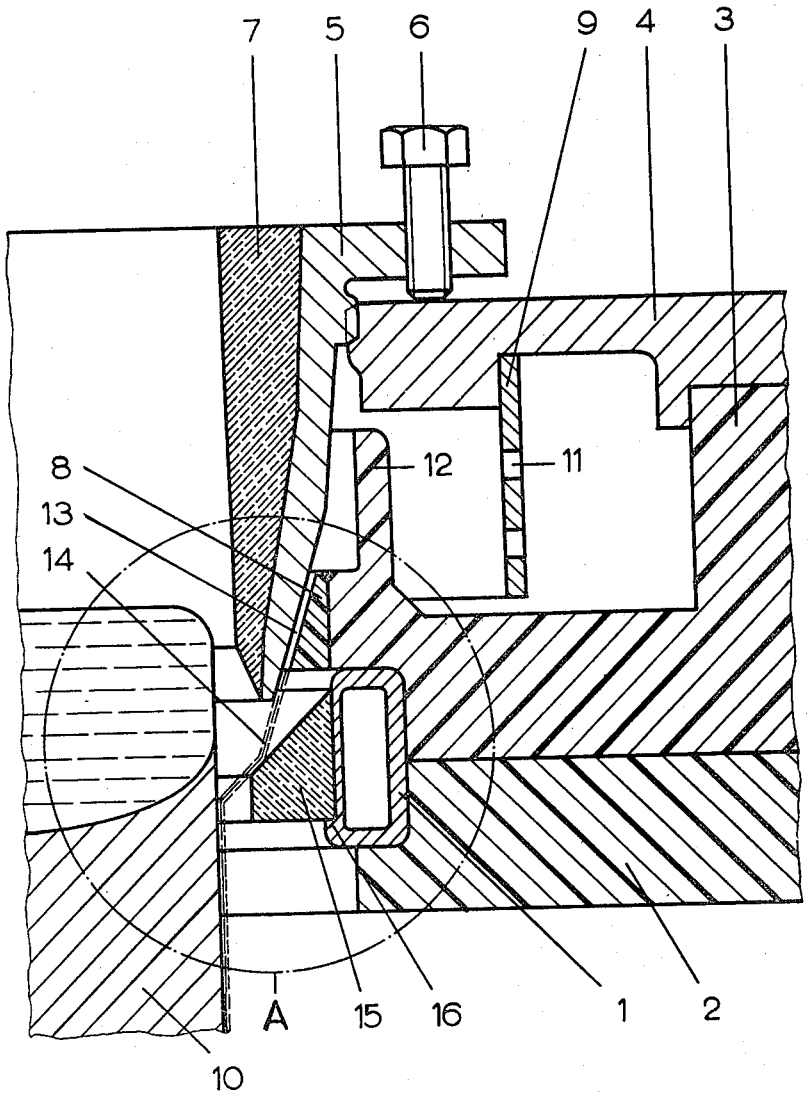

Around the inner periphery of an electromagnetic mold for casting an ingot 10 there is an induction coil 1 which, in the embodiment shown, is in the form of a hollow section. This is mounted on a multi-component supporting frame 2,3 which is made of an insulating material, preferably plastic, which features recesses on the inner side to accommodate the induction coil 1. The upper part 3 of the supporting frame is joined to a top piece 4 made of metal, such that it delimits spaces in which the coolant flows.

An electromagnetic screen 5, which is joined to the top piece 4 by means of a screw-fit thread, allows the magnetic field to be changed to accommodate the increasing metallostatic pressure in the ingot. The screen 5 can be fixed in a chosen position by means of adjustable screws 6. In the version shown in FIG. 1 a cover 7 made of a refractory, insulating material is provided in front of the screen 5 i.e. between the screen and the metal being cast.

On the inner side of the upper part 3 of the supporting frame there is an insulating part 8 which, together with the electromagnetic screen 5, forms a ring-shaped gap 13 through which the coolant is sprayed onto the ingot 10. The coolant is introduced into a space formed by the upper part 3 of the supporting frame and its top piece 4, flows through various stabilizing elements—for example sieve-type plates 9 with holes 11—over a collar-like weir 12 to exit from the ring-shaped gap 13 at a predetermined angle to the axis M of the ingot 10. The angle at which the coolant emerges is given as a result of screen 5 being designed to adjust the magnetic field so that it accommodates the metallostatic pressure in the ingot being cast.

The surface of a section 15 which projects out into the coolant 14 emerging from the gap 13 serves as an impacting surface and as a means of deflecting the coolant. The angle of inclination of the section 15 to the axis M of the ingot is determined by the extent to which the coolant 14 is to be deflected, the inner contour of the section 15 being made to suit the cross-sectional contour of the ingot 10 being cast. This section 15 is mounted with sliding fit in appropriately shaped steps or recesses 16 in the induction coil 1 or in the supporting part/parts 2,3. The sliding fit of section 15 is, under conditions of varying temperature, assured by choosing materials of comparable thermal expansion coefficients for the abutting components of the section 15 and for the induction coil or the supporting parts 2,3. If necessary, section 15 can be prevented from turning about the axis M by providing a groove and spring between the coil 1 or support 2,3 and section 15; alternatively section 15 can—if made of thin metallic sheet—be anchored between the upper side of the induction coil 1 and the support 3 or insulating part 8.

The various designs differ also in the sequence of steps required to mount the device in place: if section 15 rests on the lower part 2 of the supporting frame, these two components 15,2 are joined first, and then the induction coil 1 is put into place. If, however, the deflecting section 15 is to be on the induction coil 1 itself, the coil 1 is joined to the supporting frame 2,3 and then the deflection section 15 built on.

If section 15 is to be anchored between the induction coil 1 and part 3, then it is set on the upper edge of the induction coil and fixed in place by subsequently building on part 3 and the insulating part 8.

Figure 2:
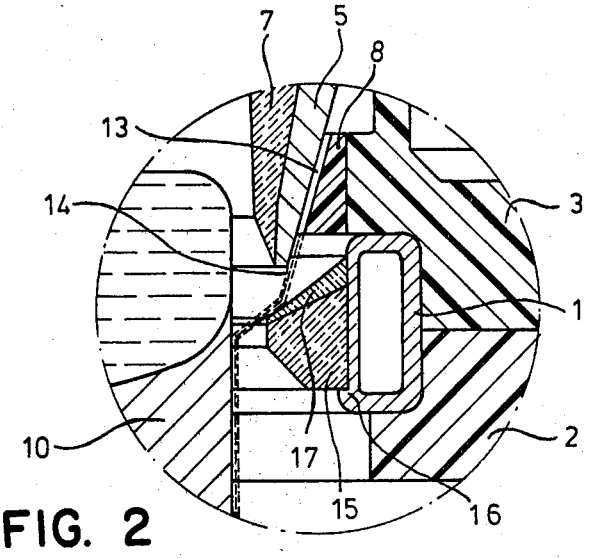

The cross section of the deflecting system 15 is generally given by the function of this part. Whether its lower edge is to be inclined, as for example in FIG. 2, depends on the kind of material chosen for the case in question and on the geometry of the casting unit being used.

Figure 3:
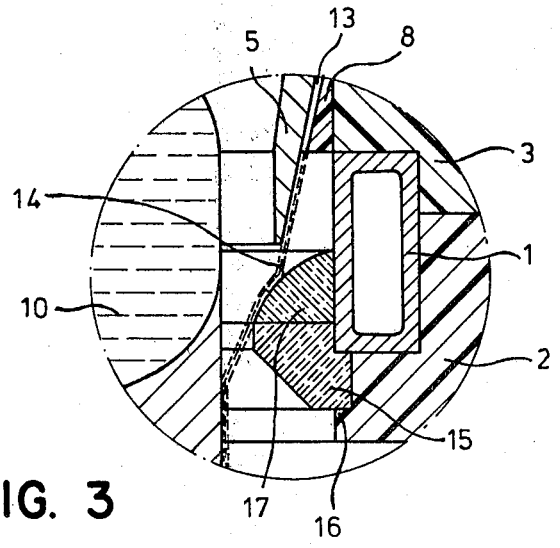
Figure 4:
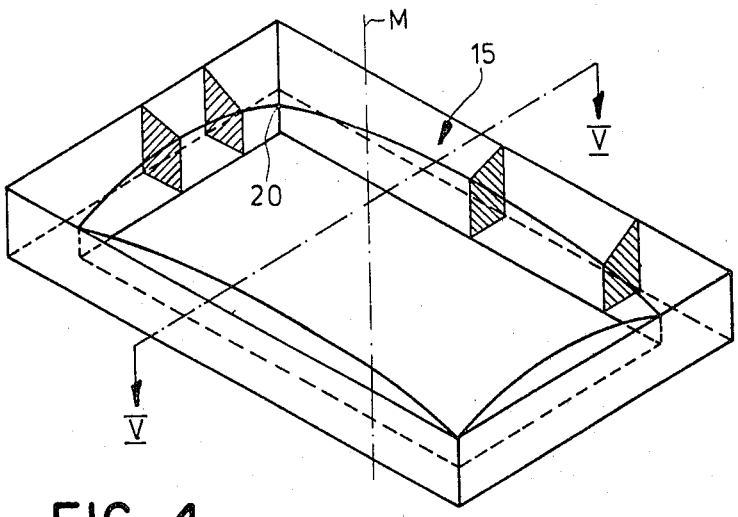
Figure 5:
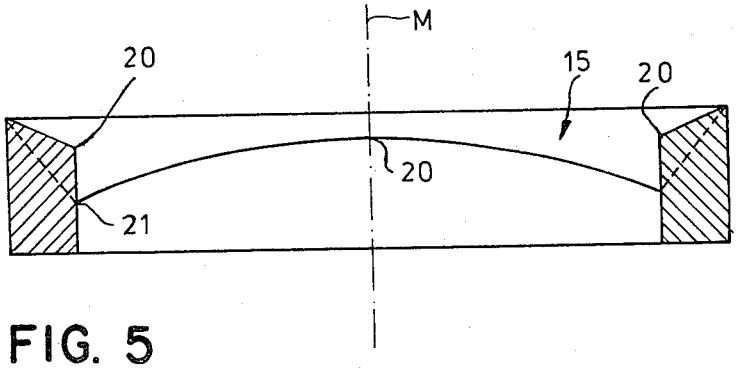

It is possible to change the level of coolant 14 impingement on ingot 10 particularly quickly, so as to accommodate the changing needs of different casts, by providing a cover or attachment 17 on section 15 to deflect the stream of coolant 14. Section 15 then acts simply as a substrate for the attachment 17, the geometry of which can be different, as the case requires. This means that not only flat pieces but also curved pieces—as in FIG. 3—can be used here, a feature which widens the range of application of the facility. It has been found for example that the angle between the stream of coolant and the surface of the ingot being cooled usefully varies between 8° and 50°. On casting aluminum and its alloys in a magnetic field of 2–3 kHz frequency and at a drop rate of 7 cm/min the optimum angle was found to be between 15° and 30°. To achieve uniform solidification in an ingot 10 of large rectangular format in cross section, the section 15 on each side of the device can, as shown in FIGS. 4 and 5, be arch-shaped with crown 20 in the middle so that the line of intersection of the coolant 14 with the ingot 10 is curved downwards in the direction of casting towards the sides 21 of the ingot 10.

Materials which can be considered for section 15 or for the attachment 17 are principally electrically insulating materials which are heat resistant and have coefficients of thermal expansion comparable to that of the induction coil 1 or the supporting frame 2,3 on which the section 15 is mounted in some cases. In practice it has been found that fiber glass reinforced epoxy type plastics with low hygroscopic tendencies are particularly suitable here. If metallic materials are used for section 15, then there must be a minimum of disturbance to the electromagnetic field. This can be achieved either by using a hollow metal section or one in which only the attachment 17 is made of thin metal sheet.

Section 15 can have different cross-sectional shapes in the various embodiments of the invention; for example in an embodiment not shown here a shaped sheet is clamped between support 3 and induction coil 1 and juts out to form an impacting surface which is inclined to the ingot 10 being cast.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A method for electromagnetically continuously casting molten metal comprising:

providing a support frame;

providing an inductor associated with said support frame for applying a magnetic field to the molten metal to define a mold cavity;

providing coolant supply means including at least one discharge nozzle for feeding a coolant stream to a first location of impingement on a surface of a cast ingot; and continuously casting metal into said mold cavity to produce a continuous casting;

providing deflecting means separate from said coolant supply means and remote and downstream of said at least one discharge nozzle for controlling the position and angle at which the coolant stream is applied to the surface of said continuous casting by deflecting and redirecting said coolant stream emanating from said at least one discharge nozzle onto a surface of said continuous casting at a second location of impingement, taken along a direction of casting withdrawal, relatively above said first location of impingement of a stream emanating from said discharge nozzle; and deflecting and redirecting said coolant stream from said first location to said second location.

2. A method according to claim 1 further including the step of impacting said coolant stream on an inclined surface for deflecting said coolant stream.

3. A method according to claim 2 further including the step of varying the angle of the incline for controlling the position and angle at which the coolant stream is applied to the surface of the ingot being cast.

4. A mold for electromagnetic continuous casting molten metal comprising a support frame, an inductor coil associated with said support frame for applying a magnetic field to define a model cavity and coolant supply means associated with said inductor including at least one discharge nozzle for feeding a coolant stream from said coolant supply means to a first location of impingement on a surface of a cast ingot for solidifying said molten metal; the improvement comprising deflecting means separate from said coolant supply means and spaced apart from and downstream of said at least one discharge nozzle for deflecting and redirecting said coolant stream emanating from said at least one discharge nozzle onto a surface of an ingot being cast at a second location of impingement taken along a direction of casting withdrawal, relatively above said first location of impingement of a stream emanating from said discharge nozzle.

5. A mold according to claim 4 wherein said inductor coil is provided with a recess and said deflecting means is supported within said recess.

6. A mold according to claim 4 wherein said support frame is provided with a recess and said deflecting means is supported within said recess.

7. A mold according to claim 4 wherein said deflecting means is formed of an electrically insulated plastic.

8. A mold according to claim 7 wherein said plastic is fiber glass reinforced epoxy plastic.

9. A mold according to claim 4 wherein said deflecting means comprises an impact surface inclined toward the direction of casting.

10. A mold according to claim 9 including means for adjusting the inclined impact surface whereby the position and angle at which the coolant stream is applied to the surface of the ingot being cast is changed.

11. A mold according to claim 9 wherein said deflecting means is exchangeable with deflecting means having impact surfaces of different inclinations so as to adjust the position and angle at which the coolant stream is applied to the surface of the ingot being cast.

12. A mold according to claim 9 wherein the radial cross section of said impact surface is a segment of a curve.

13. A mold according to claim 9 wherein the radial cross section of said impact surface is a segment of a parabola.

14. A mold according to claim 9 wherein said mold is rectangular and said deflecting means is a rectangle shape wherein said impact surface of each side of said rectangle when viewed over the entire length thereof is arc shaped with a crown in the middle.

15. A mold according to claim 9 wherein said impact surface is removably secured to said deflecting means such that impact surfaces of varying inclination are exchangeable on said deflecting means whereby the position and angle at which the coolant stream is applied to the surface of the ingot being cast may be adjusted.

16. A mold according to claim 15 wherein said impact surface is formed of an electrically insulated plastic.

17. A mold according to claim 16 wherein said plastic is fiber glass reinforced epoxy plastic.

18. A mold for electromagnetic continuous casting molten metal comprising a support frame, an inductor coil associated with said support frame for applying a magnetic field to define a mold cavity and coolant supply means associated with said inductor including at least one discharge nozzle for feeding a coolant stream from said coolant supply means to a first location of impingement on a surface of a cast ingot for solidifying said molten metal; the improvement comprising deflecting means separate from said coolant supply means and spaced apart from and downstream of said at least one discharge nozzle for controlling the position and angle at which the coolant stream is applied to an ingot being cast, said deflecting means for controlling comprises an exchangeable coolant stream deflecting means for deflecting and redirecting said coolant stream emanating from said at least one discharge nozzle onto a surface of an ingot being cast at a second location of impingement taken along a direction of casting withdrawal, relatively above said first location of impingement of a stream emanating from said discharge nozzle.

19. A mold according to claim 18 wherein said deflecting means comprises an impact surface inclined toward the direction of casting.

* * * * *

UNITED STATES PATENT AND TRADEMARK OFFICE

CERTIFICATE OF CORRECTION

PATENT NO. : 4,307,772

DATED : December 29, 1981

INVENTOR(S) : Walter Haller

It is certified that error appears in the above-identified patent and that said Letters Patent are hereby corrected as shown below:

Column 1, line 6, change "coiling" to read --cooling--.

Column 1, line 10, after "in" insert --a--.

Column 3, line 36, change "system" to read --section--.

Column 3, line 57, "To achieve" should begin a new paragraph.

Column 4, line 34, claim 1, delete "and".

Column 4, line 38, claim 1, delete "remote" and insert --spaced apart from--.

Column 4, line 61, claim 4, change "model" to --mold--.

Signed and Sealed this

Sixth Day of April 1982

[SEAL]

Attest:

GERALD J. MOSSINGHOFF

Attesting Officer

Commissioner of Patents and Trademarks